US007326896B2

(12) United States Patent
Cho

(10) Patent No.: US 7,326,896 B2
(45) Date of Patent: Feb. 5, 2008

(54) MICROWAVE OVEN

(75) Inventor: Sung-wook Cho, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 207 days.

(21) Appl. No.: 11/192,135

(22) Filed: Jul. 29, 2005

(65) Prior Publication Data

US 2006/0049192 A1 Mar. 9, 2006

(30) Foreign Application Priority Data

Sep. 6, 2004 (KR) ..... 10-2004-0070906

(51) Int. Cl.
*H05B 6/80* (2006.01)
*H05B 6/64* (2006.01)

(52) U.S. Cl. ..... 219/757; 219/681; 126/21 A; 126/299 R

(58) Field of Classification Search ..... 219/757, 219/686, 702, 710, 716, 718, 758, 681, 756, 219/691, 695, 746, 748, 683, 400; 126/273 A, 126/21 A, 299 D, 299 R, 275 E, 273 R, 126/229 R, 237 R, 110 R, 39 R; 312/296
See application file for complete search history.

(56) References Cited

U.S. PATENT DOCUMENTS 6,416,300 B1 * 7/2002 Tang et al. ..... 417/423.12
6,509,556 B2 1/2003 Kim
2005/0121445 A1 * 6/2005 Kang ..... 219/757

FOREIGN PATENT DOCUMENTS

| | | |
|---|---|---|
| EP | 0 868 113 A2 | 9/1998 |
| KR | 1999-003187 | 1/1999 |
| KR | 1020030059877 | 7/2003 |
| KR | 2004-0047077 | 6/2004 |
| KR | 1020040059674 | 7/2004 |

OTHER PUBLICATIONS

Korean Notice of Official Action issued Apr. 27, 2006 in corresponding Korean Patent Application No. 10-2004-0070906.

* cited by examiner

*Primary Examiner*—Quang Van
(74) *Attorney, Agent, or Firm*—Staas & Halsey, LLP

(57) ABSTRACT

A microwave oven including a component chamber penetrating part fluidly communicating with a component chamber, a cooking chamber penetrating part fluidly communicating with a cooking chamber, a discharging part discharging air within the cooking chamber through the cooking chamber penetrating part, and a fan assembly, including an inhaling fan ventilating the air into the component chamber penetrating part so as to cool the component chamber, a discharging fan ventilating the air within the cooking chamber into the discharging part through the cooking chamber penetrating part, and a fan motor provided between and driving the inhaling fan and the discharging fan. A detachment preventing part is provided on an inhaling fan cover and/or a discharging fan cover to prevent either of these covers from being detached from the fan assembly.

8 Claims, 4 Drawing Sheets

MICROWAVE OVEN

CROSS-REFERENCE TO RELATED APPLICATIONS

This application claims the benefit of Korean Patent Application No. 2004-70906 filed on Sep. 6, 2004, in the Korean Intellectual Property Office, the disclosure of which is incorporated herein by reference.

BACKGROUND OF THE INVENTION

1. Field of the Invention

The present invention relates to a microwave oven and, more particularly, to a microwave oven having improved structures of an inhaling fan cover and a discharging fan provided in a fan assembly.

2. Description of the Related Art

Generally a microwave oven includes a cabinet casing forming a cooking chamber cooking food therein and a component chamber in which a variety of components to radiate electromagnetic waves into the cooking chamber is disposed, a door opening and closing the cooking chamber, and a control panel provided in front of the component chamber. The microwave oven generally includes a ventilating means to inhale and discharge air within a room where the microwave oven is disposed.

As an example of this conventional microwave oven, a wall-mounted type microwave oven is disclosed in Korean Patent First Publication No. 10-2004-0047077, which is equipped with a discharging fan assembly having a discharging fan and a fan motor of a large capacity, thereby being capable of enhancing a ventilation capability of the fan, and enabling discharging holes to be disposed toward various directions by rotating the discharging fan assembly, and thereby being capable of changing a discharging direction of the air according to the shape of an external duct provided outside the cabinet of the microwave oven. In other words, the discharging fan assembly may be provided with a fan case detachably coupled to the discharging fan assembly to thereby allow a user to change a direction of the air discharged from the discharging fan, correspondently to the shape of the external duct. The fan case covers the discharging fan and has discharging holes on one side thereof, to discharge the air.

However, in the discharging fan assembly of this conventional microwave oven, where the fan case provided to change a direction of the air discharged is detached from the discharging fan assembly, the fan case is completely detached from the discharging fan assembly and thereby it may be lost.

Further, the discharging fan assembly provided in the conventional microwave oven has only been used to discharge indoor air. However, if this discharging fan assembly is used to discharge the air within the cooking chamber and at the same time to cool the components within the component chamber by ventilating the air into the component chamber, it would be more effective in use.

SUMMARY OF THE INVENTION

Accordingly, it is an aspect of the present invention to provide a microwave oven capable of preventing an inhaling fan cover and a discharging fan cover from being completely detached from a fan assembly, and cooling a component chamber and discharging the air within a cooking chamber by use of the fan assembly.

Additional aspects and/or advantages of the invention will be set forth in part in the description which follows and, in part, will be obvious from the description, or may be learned by practice of the invention.

The foregoing and/or other aspects of the present invention are achieved by providing a microwave oven having a cabinet casing forming a component chamber and a cooking chamber, including a component chamber penetrating part communicating with the component chamber, a cooking chamber penetrating part communicating with the cooking chamber, a discharging part discharging air within the cooking chamber through the cooking chamber penetrating part, and a fan assembly including an inhaling fan mounted on the cabinet casing, ventilating the air into the component chamber penetrating part so as to cool the component chamber, a discharging fan ventilating the air within the cooking chamber into the discharging part through the cooking chamber penetrating part, and a fan motor provided between the inhaling fan and the discharging fan, driving the inhaling fan and the discharging fan, wherein the inhaling fan includes an inhaling blade rotated by the fan motor and an inhaling fan cover covering the inhaling blade, the discharging fan includes a discharging blade rotated by the fan motor and a discharging fan cover covering the discharging blade, and a detachment preventing part is provided on at least one of the inhaling fan cover and the discharging fan cover, allowing at least one of the inhaling fan cover and the discharging fan cover to be positioned between the inhaling blade and the fan motor or otherwise between the discharging blade and the fan motor, to prevent the at least one of the inhaling fan cover and the discharging fan cover from being detached from fan assembly.

According to an aspect of the present invention, the detachment preventing part projects in a central direction from an end part of at least one of the inhaling fan cover and the discharging fan cover.

According to an aspect of the present invention, the fan assembly further includes a fan motor supporter supporting the fan motor; and a position determining part is provided on the at least one of the inhaling fan cover and the discharging fan cover, and the fan motor supporters, to allow at least one of the inhaling fan cover and the discharging fan cover to couple with the fan motor supporter in the coupling position.

According to an aspect of the present invention, the position determining part includes coupling projections provided on one of at least one of the inhaling fan cover and the discharging fan cover, and the fan motor supporters, and projection accommodating parts provided on the other thereof to accommodate the coupling projections therein.

According to an aspect of the present invention, the coupling projections are provided on the at least one of the inhaling fan cover and the discharging fan cover, and the projection accommodating parts are provided plurally on the fan motor supporter so as to allow the at least one of the inhaling fan cover and the discharging fan cover to be selectively coupled to the fan motor supporter.

According to an aspect of the present invention, the inhaling fan cover is provided with an inhaling part to allow the air ventilated by the inhaling blade to be supplied into the component chamber penetrating part, and the discharging fan cover is provided with a discharging blade rotated by the fan motor, and a discharging part provided outside the discharging blade to allow the air discharged from the cooking chamber penetrating part to be directed to the discharging part.

According to an aspect of the present invention, the discharging part of the cabinet casing is provided plurally to thereby allow it to be selectively coupled to the discharging part of the discharging fan cover.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Figure 1:
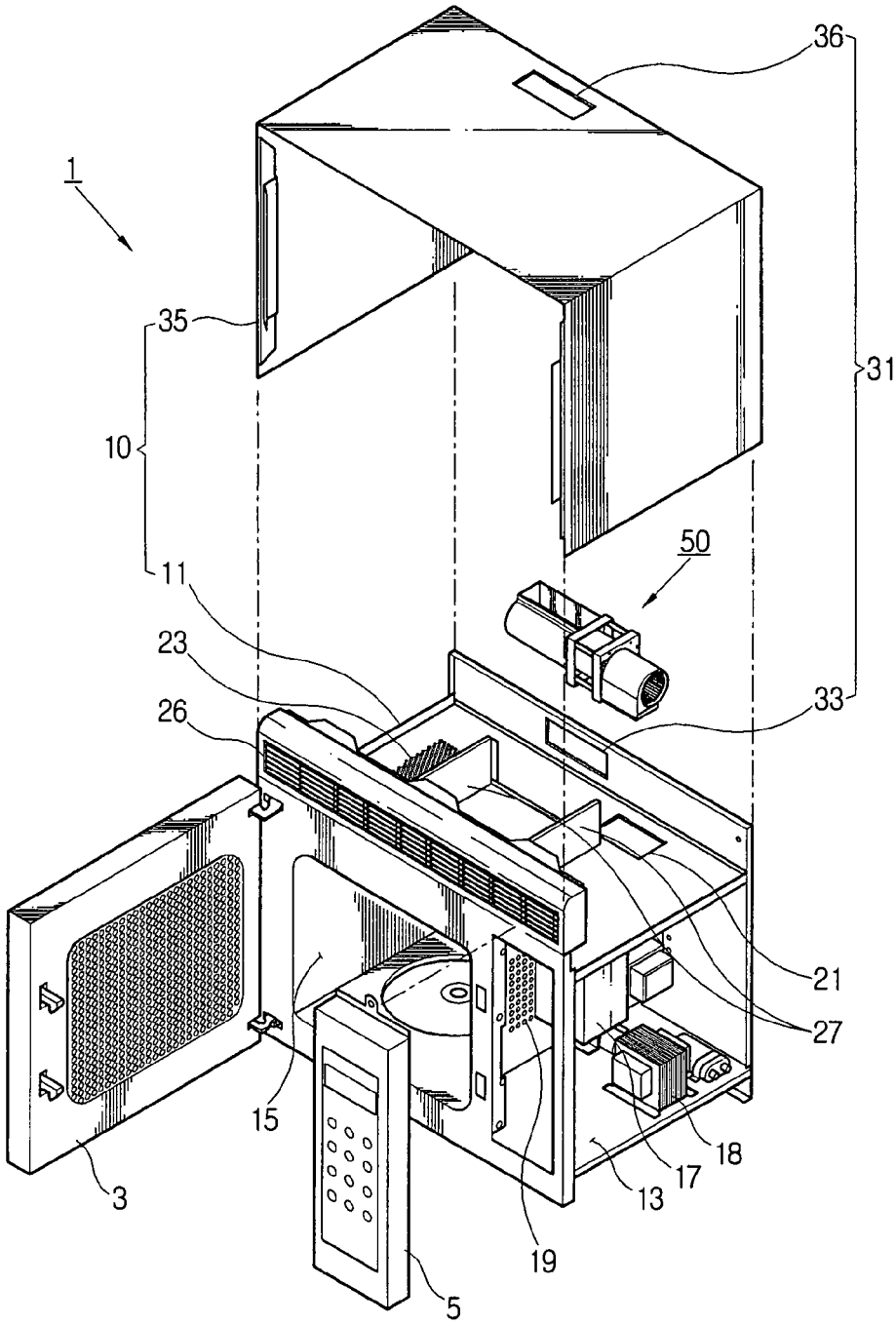
FIG. 1 is an exploded perspective view of a microwave oven according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Referring to FIGS. 1 to 4, a microwave oven according to the present invention 1 includes a cabinet casing 10 including a cabinet frame 11 forming a cooking chamber 15 cooking food and the like therein and a component chamber 13 on which a variety of components is disposed so as to radiate electromagnetic waves into the cooking chamber 15, a door 3 rotatably coupled to the cabinet casing 10, opening and closing the cooking chamber 15, a control panel 5 provided in front of the component chamber 13, controlling the variety of components, and a fan assembly 50 mounted on the cabinet casing 10, cooling the component chamber 13 and discharging air within the cooking chamber 15.

The cabinet casing 10 further includes a cabinet cover 35 covering the left and right sides and the upper side of the cabinet frame 11, and a discharging part 31 discharging air within the cooking chamber 15 through a cooking chamber penetrating part 23.

The cabinet frame 11 includes a component chamber penetrating part 21 communicating with the component chamber 13 and the cooking chamber penetrating part 23 communicating with the cooking chamber 15. The cabinet frame 11 may be made of metallic materials resistant to heat but may also be made of plastics and the like, resistant to heat. The cabinet frame 11 provided between the cooking chamber 15 and the component chamber 13 is provided with penetrating holes 19 through which the air ventilated into the component chamber 13 is supplied into the cooking chamber 15.

The cooking chamber penetrating part 23 is provided on the upper side of the cooking chamber 15, through which the air containing smell discharged from food and others is discharged.

Within the component chamber 13 are disposed such components as a magnetron 17 radiating electromagnetic waves into the cooking chamber 15 and a high voltage transformer 18. The magnetron 17 and the high voltage transformer 18 which are disposed within the component chamber 13 generate heat of high temperature while they are being operated. For this reason, the component chamber penetrating part 21 capable of inhaling external air is provided on the upper side of the component chamber 13 so as to cool them.

The component chamber penetrating part 21 and the cooking chamber penetrating part 23 may be formed by penetrating the upper side of the cabinet frame 11. Between the component chamber penetrating part 21 and the cooking chamber penetrating part 23 are provided partitioning walls 27 to prevent the air discharged from the cooking chamber penetrating part 23 from flowing back into the cooking chamber penetrating part 23.

The partitioning walls 27 are inserted between the cabinet frame 11 and the cabinet cover 35. The partitioning walls 27 guide the air discharged from the cooking chamber penetrating part 23 so as to be discharged into the discharging part 31 by a discharging fan 61 of the fan assembly 50 to be described later (see FIG. 2). The partitioning walls 27 are each elongated in a forward and backward direction between the cabinet frame 11 and the cabinet cover 35. The partitioning walls 27 are provided in a pair and separated from each other. Between the pair of partitioning walls 27 is installed a lamp (not shown) to illuminate the cooking chamber 15. On the upper side of the cabinet frame 11 are provided light penetrating holes (not shown) corresponding to the lamp (not shown), through which light generated by the lamp (not shown) illuminates the cooking chamber 15. In front of the partitioning walls 27 is installed a grill formed with inhaling holes to inhale therethrough indoor air within the room in which the microwave oven 1 is installed. Accordingly, the discharging fan 61 of the fan assembly 50 to be described later discharges the air within the cooking chamber 15 and the indoor air guided by the partitioning walls 27, from the cooking chamber penetrating part 23 and the grill 26.

The discharging part 31 is provided through the cabinet casing 10 so as to discharge the air within the cooking chamber and the indoor air through the cooking chamber penetrating part 23 and the grill 26. The discharging part 31 may be connected to an external duct extended to the outside so as to discharge the air within the cooking chamber 15 and the indoor air to the outside. The discharging part 31 may be provided plurally to thereby correspond to the shape of an external duct (not shown) of a structure on which the microwave oven 1 is to be installed. That is, the external duct (not shown) of the structure may be positioned on the top side of the microwave oven 1 or otherwise on the back of the microwave oven 1. By way of an example in the present invention, the discharging part 31 is provided on the back and on the top face of the cabinet casing 10, considering that the external duct (not shown) is positioned on the top side or the back of the microwave oven 1. The discharging part 31 includes a first discharging part 33 provided in the top rear of the cabinet frame 11 and a second discharging part 33 provided on the back of the cabinet cover 35. However, this discharging part 31 may be further provided on any one of the left and right sides, or on the front and lower sides of the cabinet casing 10. A user can connect any one among the plurality of discharging parts 31 to the external duct (not shown) of the structure.

The cabinet cover 35 is provided in the shape of reverse-U letter outside the cabinet frame 11. The cabinet cover 35 is coupled to the cabinet frame 11 by means of screws and the like. On the top face of the cabinet cover 35 is formed the second discharging part 36.

Figure 2:
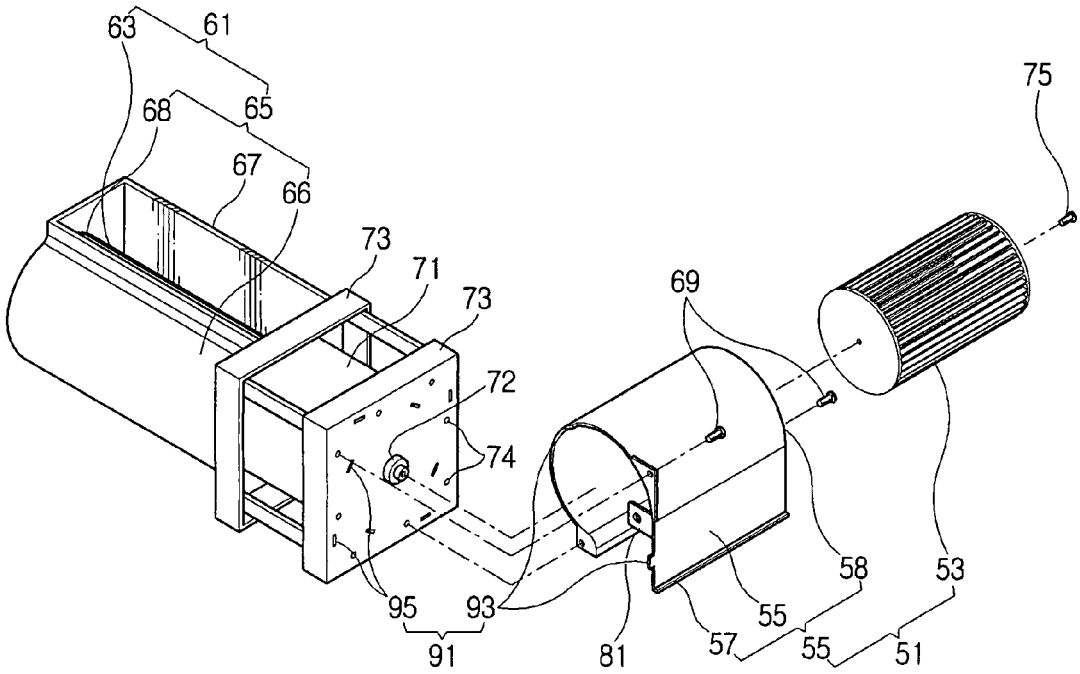
FIG. 2 is an exploded perspective view illustrating a fan assembly of the microwave oven according to the present invention.
Figure 3:
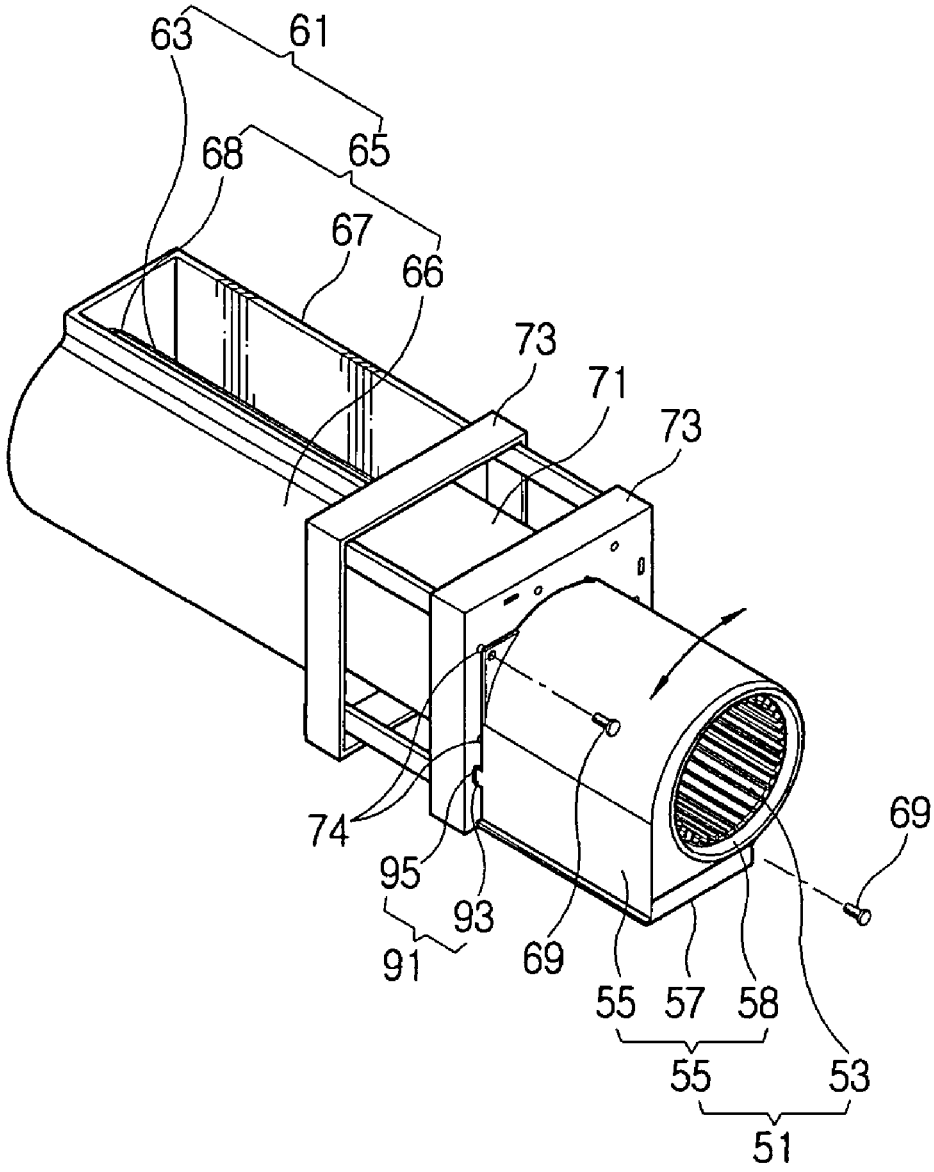
FIG. 3 is a perspective view illustrating the fan assembly of the microwave oven according to the present invention.
Figure 4:
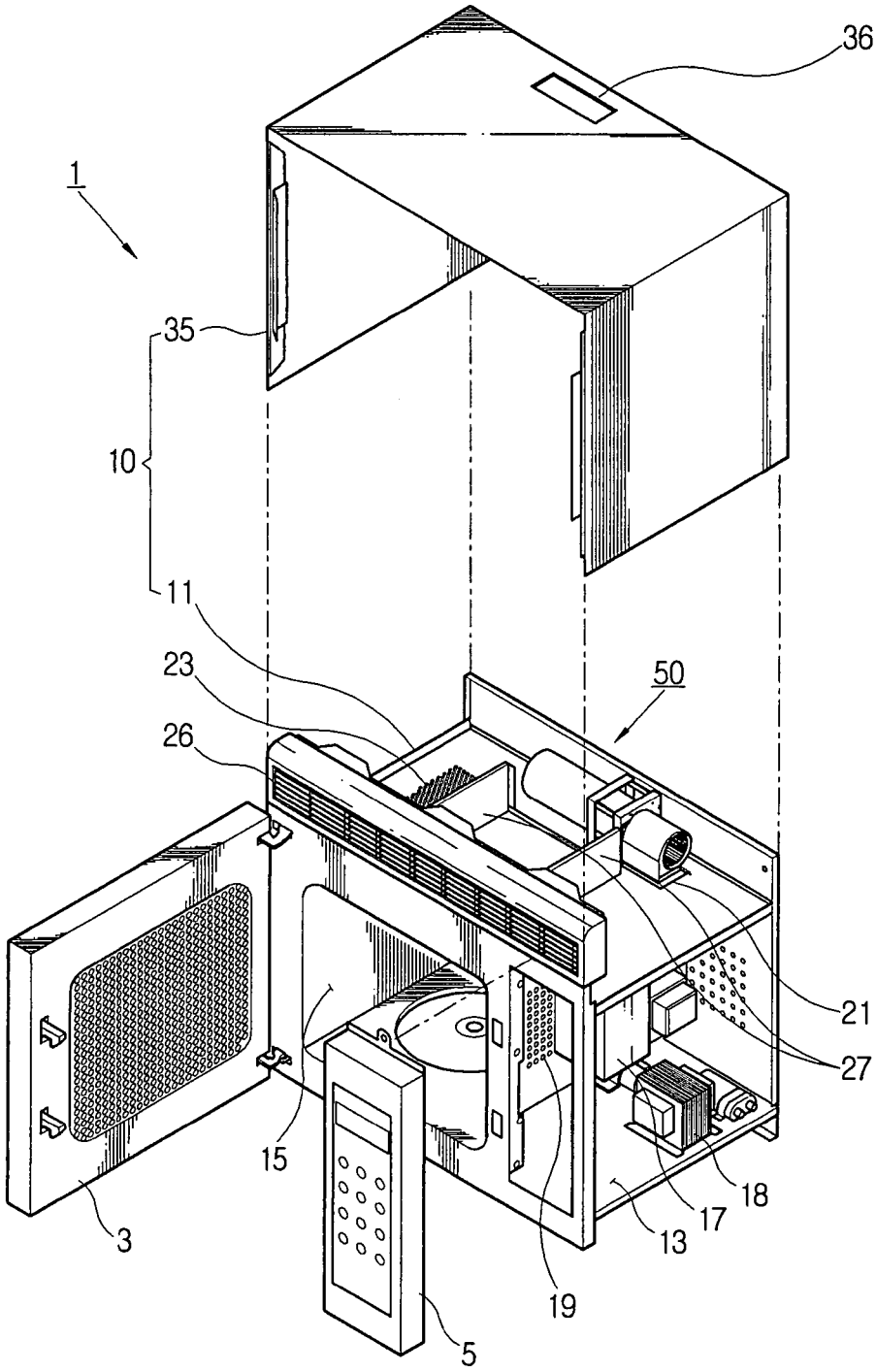
FIG. 4 is a perspective view of the fan assembly mounted on the microwave oven according to the present invention.

Referring to FIGS. 2 and 3, the fan assembly 50 includes an inhaling fan 51 ventilating air into the component chamber penetrating part 21 to cool the component chamber 13, a discharging fan 61 ventilating the air within the cooking chamber 15 into the discharging part 31 through the cooking chamber penetrating part 23, and a fan motor 71 provided between the inhaling fan 51 and the discharging fan 61, driving the inhaling fan 51 and the discharging fan 61. The fan assembly 50 is provided on the upper rear of the cabinet casing 10, correspondently with the component chamber penetrating part 21 and the discharging part 31. The fan assembly 50 is provided between the cabinet frame 11 and the cabinet cover 35 and in the rear region of the partitioning walls 27.

The inhaling fan 51 includes an inhaling blade 53 rotated by the fan motor 71 and an inhaling fan cover 55 provided outside the inhaling blade 53 to direct the air ventilated by the inhaling blade 53 to the component chamber penetrating part 21. The inhaling fan 51 is provided on one side of the fan motor 71, corresponding to the component chamber penetrating part 21.

The inhaling blade 53 is coupled to a rotational shaft 72 of the fan motor 71 by means of a coupling bolt 75 to thereby rotate integrally with the rotational shaft 72. The inhaling blade 53 may be a plurality of blades disposed circularly around a rotational shaft of the fan motor 71.

The inhaling fan cover 55 is provided with a detachment preventing part 81, secured by, e.g., a screw 82, to prevent the inhaling fan cover 55 from being detached from the inhaling fan 51. A position determining part 91 may be provided on the inhaling fan cover 55 and a fan motor supporter 73 to be described later, allowing the inhaling fan cover 55 to determine a coupling position to couple with the fan motor supporter 73. The inhaling fan cover 55 includes an inhaling cover body 56 shaped generally like a cylinder, accommodating the inhaling blade 53, an inhaling part 57 extended from the cylindrical inhaling cover body 56 so as to collect and discharge the ventilated air generated due to rotation of the inhaling blade 53, and an inhaling cover penetrating part 58 provided to absorb ambient air conversely to the coupling direction with the fan motor 71. The inhaling fan cover 55 is detachably and rotatably coupled to the fan motor supporter 73 to be described later. That is, the inhaling fan cover 55 is detachably coupled to the fan motor supporter to be described later by means of screws 69. Under the state that the inhaling fan cover 55 is disassembled from the fan motor supporter 73 to be described later, after the inhaling fan cover 55 has been rotated so as to allow an exhausting part 67 of the discharging fan cover 65 to be directed to any one of the first and the second discharging parts 33 and 36, and to allow the inhaling part 57 of the inhaling fan cover 55 to be directed to the component chamber penetrating part 21, it is again coupled to the fan motor supporter 73 by means of the screws 69, whereby the inhaling fan cover 55 and the fan motor supporter 73 may be easily disassembled or assembled to allow the exhausting part 67 to be directed to the discharging part 31 correspondently to the external duct (not shown). Herein, coupling means of the inhaling fan cover 55 to the fan motor supporter 73 to be described later is not limited to the screws: the coupling may be done by use of a locking means (not shown) including a hooking projection, a projection coupling part and so on, which allow the inhaling fan cover 55 to be detachably coupled to the fan motor supporter 73.

The inhaling cover body 56 has a diameter increasing to a rotational direction of the inhaling blade 53, to collect the blowing air generated due to rotation of the inhaling blade 53. The inhaling part 57 is projected from the inhaling cover body 56 correspondently to the component chamber penetrating part 21.

The discharging fan 61 includes a discharging blade 63 rotated by the fan motor 71 and a discharging fan cover 65 provided outside the discharging blade 63, allowing the air ventilated by the discharging blade 63 to be directed to the discharging part 31. The discharging fan 61 is provided on the other side of the fan motor 71, correspondently to any one of the first and the second discharging parts 33 and 36.

The discharging blade 63 is provided plurally, which are disposed with the shape of a cylinder around the rotational shaft of the fan motor so as to be rotated by the fan motor 71.

The discharging fan cover 65 is provided in the shape of a cylinder, including a discharging cover body 66 accommodating the discharging blade 63, a The exhausting part 67 extended from the cylindrical discharging cover body 66 to collect and discharge the ventilated air generated due to rotation of the discharging blade 63, and a discharging cover penetrating part 68 provided to inhale from the cooking chamber penetrating part 23 and the grill 26 conversely to the coupling direction with the fan motor 71. The discharging fan cover 65 may be detachably and rotatably coupled to another fan motor supporter 73 to be described later, to thereby allow the exhausting part 67 to be directed to any one of the components of the discharging part 31. However, the discharging fan cover 65 may be coupled integrally with the fan motor supporter 73 to be described later.

Like the inhaling cover body 56 described above, the discharge cover body 66 has a diameter increasing to a rotational direction of the discharging blade 63, to collect the blowing air generated due to rotation of the discharging blade 63 into the exhausting part 67. The exhausting part 67 is projected from the inhaling cover body 56 correspondently to the discharging part 31.

The fan motor 71 is provided between the inhaling fan 51 and the discharging fan 61, rotating the inhaling blade 53 and the discharging blade 63. The fan motor 71 is supported by the fan motor supporters 73 provided on both sides thereof, being coupled to the inhaling fan 51 and the discharging fan 61.

The fan motor supporter 73 is provided with screw engaging parts 74 whereby the fan motor supporter 73 is coupled with the inhaling fan cover 55 by means of the screws 69. The fan motor supporter 73 is provided with a plurality of projection accommodating parts 95 to receive therein coupling projections 93 of the position determining part 91 to be described later.

The detachment preventing part 81 is provided on at least one of the inhaling fan cover 55 and the discharging fan cover 65, thereby preventing at least one of the inhaling fan cover 55 and the discharging fan cover 65 from being completely detached from the inhaling fan 51 or otherwise the discharging fan 61. The detachment preventing part 81 may be provided between the inhaling blade 53 and the fan motor 71 or otherwise between the discharging blade 63 and the fan motor 71.

Hereinafter, an exemplary embodiment of the present invention will be described under the assumption that the detachment preventing part 81 is provided on the inhaling fan cover 55. However, this detachment preventing part 81 may be provided on the discharging fan cover 65.

The detachment preventing part 81 is formed on an end of the inhaling fan cover 55 in the center thereof, so that it is positioned between the fan motor supporter 73 and the inhaling blade 53. In other words, between the fan motor supporter 73 and the inhaling blade 53 is provided a space to separate them from each other, whereby the fan motor supporter 73 does not interfere with rotation of the inhaling blade 53. Namely, the detachment preventing part 81 is disposed in the separating space between the fan motor supporter 73 and the inhaling blade 53. Accordingly, the detachment preventing part 81 can prevent the inhaling fan cover 55 from being completely detached from the inhaling fan 51 by interfering with the inhaling blade 53 coupled to the fan motor 71.

The position determining part 91 is provided so as to allow at least one of the inhaling fan cover 55 and the discharging fan cover 65 to determine a coupling position with the fan motor supporter 73. The position determining part 91 includes coupling projections 93 provided on at least one of the inhaling fan cover 55 and the discharging fan cover 65, and the fan motor supporters 73, and projection accommodating parts 95 provided on the other thereof to accommodate the coupling projections.

Hereinafter, an exemplary embodiment of the present invention will be described under the condition that the position determining parts 91 are provided on the inhaling fan cover 55 and the fan motor supporter 73. However, the position determining parts 91 may be provided on the discharging fan cover 65 and the fan motor supporter 73.

The coupling projections 93 provided on the inhaling fan cover 55 are inserted, for coupling, into the projection accommodating parts 95 provided on the fan motor supporter 73. The coupling projections 93 are provided in a pair on the inhaling fan cover, but may be provided singularly, or three or more. Further, the coupling projections 93 may be provided on the fan motor supporter 73, in which case the projection accommodating parts 95 are provided on the inhaling fan cover 55. Further, the coupling projections 93 may be provided on the discharging fan cover 65.

The projection accommodating parts 95 may be provided on the fan motor supporter 73, to allow the coupling projections 93 of the inhaling fan cover 55 to be coupled thereto. The projection accommodating parts 95 may be provided plurally so that the inhaling fan cover 55 is rotated relative to the fan motor supporter 73 to thereby allow the coupling projections 93 of the inhaling fan cover 55 to be selectively coupled thereto. However, the projection accommodating parts 95 may be provided on at least one of the inhaling fan cover 55 and the discharging fan cover 65, in which case the coupling projections 93 are provided on the fan motor supporter 73. Accordingly, after at least one of the inhaling fan cover 55 and the discharging fan cover 65 is rotated by the position determining part 91 relative to the fan motor supporter 73, they may be easily positioned on the coupling positions.

With this configuration, a process of assembling the fan assembly to the cabinet casing in the microwave oven according to the present invention will be described below.

A discharging part 31 corresponding to an external duct (not shown) is first selected. An inhaling fan cover 55 is rotated and then assembled again so as to allow a exhausting part 67 of a discharging fan cover 65 and an inhaling part 57 of an inhaling fan cover 55 to be disposed in the selected discharging part 31 and a component chamber penetrating part 21, respectively. That is, after a screw 69 to engage the inhaling fan cover 55 with a fan motor supporter 73 has first been disassembled, the inhaling fan cover 55 is rotated so as to insert coupling projections 93 of the inhaling fan cover 55 into projection accommodating parts 95 of the fan motor supporter 73. Thereafter, the inhaling fan cover 55 is again engaged with the fan motor supporter 73 by means of the screws 69.

The microwave oven according to the present invention is capable of preventing at least one of an inhaling fan cover and a discharging fan cover from being completely detached from a fan assembly by providing it with a detachment preventing part, and as a result, preventing at least one of the inhaling fan cover and the discharging fan cover from being lost.

Further, the microwave oven according to the present invention may cool the component chamber and discharge air within the cooking chamber by providing it with a fan assembly formed with an inhaling fan and a discharging fan.

Still further, the microwave oven according to the present invention may easily couple at least one of the inhaling fan cover and the discharging fan cover to a fan motor supporter in the coupling position by providing it with a position determining part.

As described above, according to the present invention, there is provided a microwave oven capable of preventing at least one of an inhaling fan cover and a discharging fan cover from being completely detached from a fan assembly, and cooling a component chamber and discharging the air within a cooking chamber by use of the fan assembly.

Further, the microwave oven according to the present invention may easily couple at least one of the inhaling fan cover and the discharging fan cover to a fan motor supporter in the coupling position by providing it with a position determining part.

Although the present invention has been described in connection with the exemplary embodiments illustrated in the accompanying drawings, it should be understood that the present invention is not limited thereto and those skilled in the art can make various modifications and changes without departing from the scope of the invention.

What is claimed is:

1. A microwave oven comprising:

a component chamber, a cooking chamber, a component chamber penetrating part in fluid communication with the component chamber, a cooking chamber penetrating part in fluid communication with the cooking chamber, and a discharging part discharging air from the microwave oven; and a fan assembly, including an inhaling fan moving air through the component chamber penetrating part and into the component chamber so as to cool the component chamber, and a discharging fan moving air from the cooking chamber, through the cooking chamber penetrating part and through the discharging part, wherein the inhaling fan includes an inhaling fan cover, and the discharging fan includes a discharging fan cover, and a detachment preventing part is connected to at least one of the inhaling fan cover and the discharging fan cover to prevent the at least one of the inhaling fan cover and the discharging fan cover from being detached from the fan assembly, wherein the detachment preventing part projects inward from an end part of at least one of the inhaling fan cover and the discharging fan cover.

2. The microwave oven according to claim 1, further comprising a single fan motor for driving the inhaling fan and the discharging fan.

3. The microwave oven according to claim 2, wherein the fan assembly further comprises a fan motor supporter supporting the fan motor.

4. The microwave oven according to claim 3, further comprising a position determining part provided on the at least one of the inhaling fan cover and the discharging fan cover, and the fan motor supporter, to allow at least one of the inhaling fan cover and the discharging fan cover to couple with the fan motor supporter.

5. The microwave oven according to claim 4, wherein the position determining part includes coupling projections provided on at least one of the inhaling fan cover and the discharging fan cover, and the fan motor supporter, and projection accommodating parts provided on the other of the inhaling fan cover and the discharging fan cover to accommodate the coupling projections therein.

6. The microwave oven according to claim 5, wherein the coupling projections are provided on the at least one of the inhaling fan cover and the discharging fan cover at a plurality of positions, and the projection accommodating parts are provided on the fan motor supporter so as to allow the at least one of the inhaling fan cover and the discharging fan cover to be selectively coupled to the fan motor supporter in any one of the plurality of the positions.

7. The microwave oven according to claim 1, wherein the inhaling fan cover is provided with an inhaling part to receive air to be moved into the component chamber penetrating part, and the discharging fan cover is provided with an exhausting part to allow the air discharged from the cooking chamber penetrating part to be directed to the discharging part of the microwave oven.

8. The microwave oven according to claim 7, wherein the microwave oven includes a plurality of the discharging parts, each capable of being coupled to the exhausting part of the discharging fan cover.

* * * * *